US008833477B2

(12) United States Patent
Kang

(10) Patent No.: US 8,833,477 B2
(45) Date of Patent: Sep. 16, 2014

(54) MULTIFUNCTIONAL PORTABLE FIRE EXTINGUISHER SYSTEM

(75) Inventor: Yun-Beom Kang, Daejeon (KR)

(73) Assignee: Frunezone Co., Ltd., Daejeon (KR)

( * ) Notice: Subject to any disclaimer, the term of this patent is extended or adjusted under 35 U.S.C. 154(b) by 700 days.

(21) Appl. No.: 13/142,638

(22) PCT Filed: Apr. 30, 2010

(86) PCT No.: PCT/KR2010/002736

§ 371 (c)(1),
(2), (4) Date: Jun. 29, 2011

(87) PCT Pub. No.: WO2011/002150

PCT Pub. Date: Jun. 1, 2011

(65) Prior Publication Data

US 2011/0266010 A1 Nov. 3, 2011

(30) Foreign Application Priority Data

Jul. 2, 2009 (KR) ..... 10-2009-0060174

(51) Int. Cl.

| | |
|---|---|
| ***A62C 11/00*** | (2006.01) |
| ***A62C 25/00*** | (2006.01) |
| ***A62C 27/00*** | (2006.01) |
| ***A62C 29/00*** | (2006.01) |
| ***A62C 17/00*** | (2006.01) |
| ***A62C 13/76*** | (2006.01) |

(52) U.S. Cl.

CPC ..... *A62C 17/00* (2013.01); *A62C 13/76* (2013.01)

USPC ..... 169/30; 169/51; 239/71; 239/526

(58) Field of Classification Search

USPC ..... 169/30, 51, 71–89, 91; 239/71, 72, 146, 239/152, 153, 154, 526

See application file for complete search history.

(56) References Cited

U.S. PATENT DOCUMENTS

| | | | | |
|---|---|---|---|---|
| 3,802,511 | A * | 4/1974 | Good, Jr. | 169/30 |
| 4,972,910 | A * | 11/1990 | Fujiki | 169/60 |
| 5,195,595 | A * | 3/1993 | Nakagawa | 169/51 |
| 7,271,704 | B2 * | 9/2007 | McSheffrey et al. | 340/286.05 |
| 7,726,411 | B2 * | 6/2010 | McSheffrey et al. | 169/75 |

FOREIGN PATENT DOCUMENTS

| | | |
|---|---|---|
| JP | 07-031690 | 2/1995 |
| JP | 08-229154 | 9/1998 |
| JP | 2004-113498 | 4/2004 |
| KR | 100748612 | 8/2007 |
| KR | 1020070090064 | 9/2007 |

* cited by examiner

*Primary Examiner* — Justin Jonaitis

(74) *Attorney, Agent, or Firm* — IPLA P.A.; James E. Bame

(57) ABSTRACT

A multifunctional portable fire extinguisher system comprising: a multifunctional portable fire extinguisher with a handgun configuration that sprays fire-extinguishing liquid stored therein through a spraying portion to the outside in accordance with the actuation of a trigger; and a multifunctional portable fire extinguisher case including a housing for housing the multifunctional portable fire extinguisher and a protective cover for protecting the multifunctional portable fire extinguisher housed in the housing. The housing of the multifunctional portable fire extinguisher case includes: a first sensor unit for detecting the temperature, gas, smoke, and power failure, and for generating first detection data; and a first short range wireless communication unit for performing short range wireless communication with the multifunctional portable fire extinguisher. The protective cover of the multifunctional portable fire extinguisher case includes: a first display unit for displaying a danger level in terms of the temperature, gas, smoke, and power failure detected by the first sensor unit; and a lock adjustment unit for separating and opening the protective cover from the housing.

10 Claims, 5 Drawing Sheets

MULTIFUNCTIONAL PORTABLE FIRE EXTINGUISHER SYSTEM

BACKGROUND OF THE INVENTION

The present invention relates to a multifunctional portable fire extinguisher system in that a multifunctional portable fire extinguisher case and a multifunctional portable fire extinguisher are provided, thereby dealing with emergency or fire.

Generally, a fire extinguisher serves to block the oxygen among conditions of fire such as burning materials, oxygen, and fire temperature (fire point) and reduce the heat through a specific extinguishing agent. There are a powder fire extinguisher, a carbon fire extinguisher, and a halogen fire extinguisher.

In the usage of the fire extinguisher, the user removes the safety pin and then a hose of the extinguisher faces the fire. Thereafter, the user strongly grasps the handle and then, it spouts the extinguishing liquid toward the fire, thereby extinguishing the initial fire.

The conventional fire extinguisher having the above construction does not have a portable size and is equipped in a house or a car etc., which is in a conspicuous place. However, it is not easy to find it in case of emergency, especially at night and the using procedures such as the remove of the safety pin etc. is complicated, so that it cannot appropriately be used. Accordingly, since it fails to extinguish the initial fire, there are problems in that the losses of both life and property are occurred. Also, since the conventional fire extinguisher is used against only the fire, there is a problem in that it cannot have a lot of useful functions.

Also, since the conventional fire extinguisher is simply utilized for extinguishment, has no consideration for air cleaning, and is not interconnected to other servers and terminals, there is a limit that it is a merely instrument.

SUMMARY OF THE INVENTION

Therefore, the present invention has been made in view of the above-mentioned problems, and the primary object of the present invention is to provide a multifunctional portable fire extinguisher system in that it has a extinguishing function, a lighting function, and an alarming function and can easily confirm the position thereof at night, thereby utilizing for extinguishing the initial fire and self-defense.

Another object of the present invention is to provide a multifunctional portable fire extinguisher system in that an AC power is converted into a DC power in case of emergency or fire, so that a light unit turns on through the emergency power source and at the same time, it can inform servers of public institutions or mobile terminals of the emergency and fire situations.

Further another object of the present invention is to provide a multifunctional portable fire extinguisher system in that an anion generator is mounted therein, thereby performing a purification of the blood, an increase of the resistance, an adjustment of autonomic nerve, an air cleaning, a dirt removal, and a sterilizing action.

Further another object of the present invention is to provide a multifunctional portable fire extinguisher system in that a manual switch is provided therein, thereby the user can directly send the emergency situations.

In accordance with an aspect of the present invention to achieve the objects thereof, there is provided a multifunctional portable fire extinguisher system comprising: a multifunctional portable fire extinguisher with a handgun configuration that sprays a fire-extinguishing liquid stored therein through a spraying portion to the outside in accordance with the actuation of a trigger; and a multifunctional portable fire extinguisher case comprising a housing for housing the multifunctional portable fire extinguisher having a first sensor unit for detecting a temperature, a gas, a smoke, and a power failure and for generating a first detection data, and a first short range wireless communication unit for performing a short range wireless communication with the multifunctional portable fire extinguisher; and a protective cover for protecting the multifunctional portable fire extinguisher housed in the housing having a first display unit for displaying a danger level in terms of the temperature, the gas, the smoke, and the power failure detected by the first sensor unit, and a lock adjustment unit for separating and opening/closing the protective cover from the housing.

In accordance with another aspect of the present invention to achieve the objects thereof, the multifunctional portable fire extinguisher case further comprises a voice output unit for outputting a warning call and a request voice signal on the danger level in terms of the temperature, the gas, the smoke, and the power failure detected by the first sensor unit to the outside.

In accordance with further another aspect of the present invention to achieve the objects thereof, the multifunctional portable fire extinguisher case further comprises a first control unit for controlling the first sensor unit, the first short range wireless communication unit, and the first display unit and a light unit for identifying a position of the multifunctional portable fire extinguisher case.

In accordance with further another aspect of the present invention to achieve the objects thereof, the multifunctional portable fire extinguisher case further comprises a first emergency button unit for issuing orders for delivering a warning call and a warning voice to a voice output unit.

In accordance with further another aspect of the present invention to achieve the objects thereof, the multifunctional portable fire extinguisher further comprises a second short range wireless communication unit for performing a short range wireless communication with the first short range wireless communication unit of the multifunctional portable fire extinguisher case; a second sensor unit for detecting the temperature, the gas, the smoke, and the power failure and generating a second detection data according to the detected signal formed inside the multifunctional portable fire extinguisher; a second display unit for displaying the danger level in terms of the temperature, the gas, the smoke, and the power failure; a second emergency button unit for generating an emergency data so as to inform dangerous situations to the outside; and infrared display unit for displaying the danger level in terms of the temperature, the gas, the smoke, and the power failure through an infrared light; and a second control unit for controlling the second display unit and the infrared display unit in such a manner that they output data received from any of the second short range wireless communication unit, the second sense unit, and the second emergency button unit thereon.

In accordance with further another aspect of the present invention to achieve the objects thereof, the multifunctional portable fire extinguisher further comprises a transmitting/receiving unit for transmitting address information stored in advance to a server of public institutions or mobile terminals set in advance.

In accordance with further another aspect of the present invention to achieve the objects thereof, the multifunctional portable fire extinguisher further comprises an anion generator for generating an anion in accordance with the detected temperature, gas, smoke, and power failure.

In accordance with further another aspect of the present invention to achieve the objects thereof, an AC power is converted into a DC power in the multifunctional portable fire extinguisher according to an input of the second emergency button unit.

In accordance with further another aspect of the present invention to achieve the objects thereof, the multifunctional portable fire extinguisher further comprises a voice output unit for outputting a warning call and a request voice signal on the danger level in terms of the temperature, the gas, the smoke, and the power failure detected by the second sensor unit to the outside.

In accordance with further another aspect of the present invention to achieve the objects thereof, a manual switch for manually operating the second display unit and a voice output unit is formed at an exterior body of the multifunctional portable fire extinguisher and the manual switch is operated by the power of a battery, which is formed inside the exterior body, so that a light beam is irradiated through the second display unit and a dangerousness is informed through a speaker of the voice output unit.

According to the multifunctional portable fire extinguisher system as described above, there is an effect in that it has a extinguishing function, a lighting function, and an alarming function and can easily confirm the position thereof at night, thereby utilizing for extinguishing the initial fire and self-defense.

Also, there is another effect in that the AC power is converted into the DC power in case of emergency or fire, so that the light unit turns on through the emergency power source and at the same time, it can inform servers of public institutions or mobile terminals of the emergency and fire situations.

Moreover, there is further another effect in that the anion generator is mounted therein, thereby performing a purification of the blood, an increase of the resistance, an adjustment of autonomic nerve, an air cleaning, a dirt removal, and a sterilizing action.

Furthermore, there is further another effect in that the manual switch is provided therein, thereby the user can directly send the emergency situations.

BRIEF DESCRIPTION OF THE DRAWINGS

The foregoing and other objects, features and advantages of the present invention will become more apparent from the following detailed description when taken in conjunction with the accompanying drawings in which.

DESCRIPTIONS ON REFERENCE NUMBERS FOR THE MAJOR COMPONENTS IN THE DRAWINGS

Figure 1:
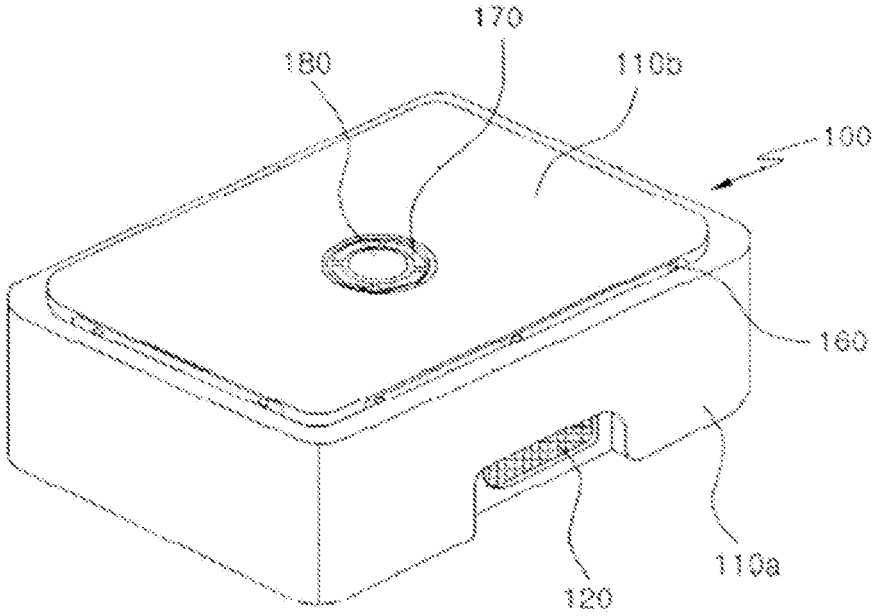
FIG. 1 is a perspective view illustrating a multifunctional portable fire extinguisher case according to the present invention.

100: multifunctional portable fire extinguisher case 110*a*: housing
110*b*: protective cover
111: opening portion
112: holder
120: first sensor unit
130: short range wireless communication unit
140: first control unit 150: voice output unit
160: light unit 170: first display unit
180: first emergency button unit
190: lock adjustment unit
200: multifunctional portable fire extinguisher
210: exterior body
211: fire-extinguishing liquid container
212: spraying portion 213: trigger
220: second sensor unit
230: second short range wireless communication unit
240: second display unit 250: infrared display unit
260: second control unit
270: second emergency button unit
280: transmitting/receiving unit
290: anion generator 300: voice output unit
320: manual switch 340: battery

DETAILED DESCRIPTION OF THE INVENTION

Hereinafter, exemplary embodiments of the present invention will be described in detail with reference to the accompanying drawings.

Figure 2:
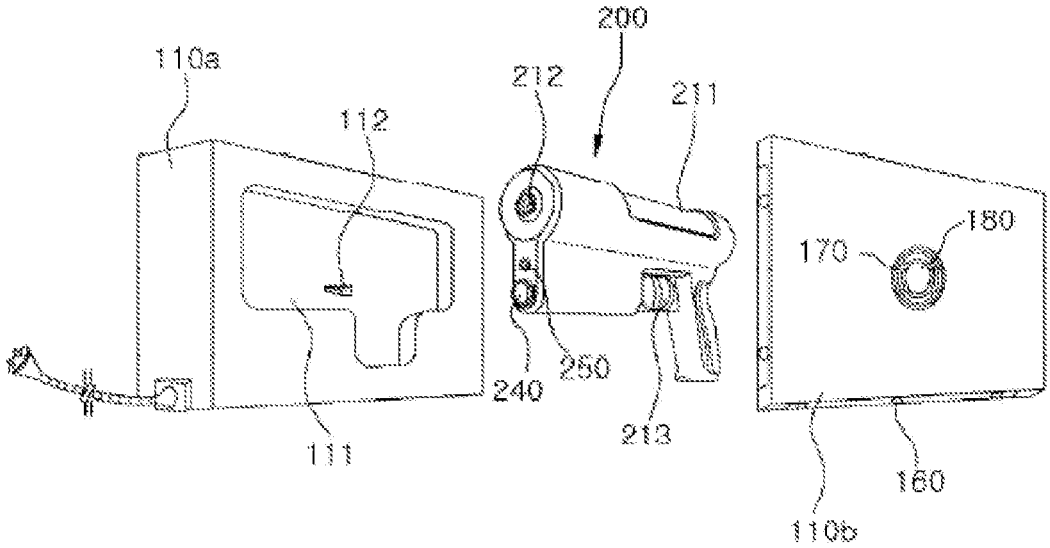
FIG. 2 is an exploded perspective view illustrating a multifunctional portable fire extinguisher case according to the present invention.
Figure 3:
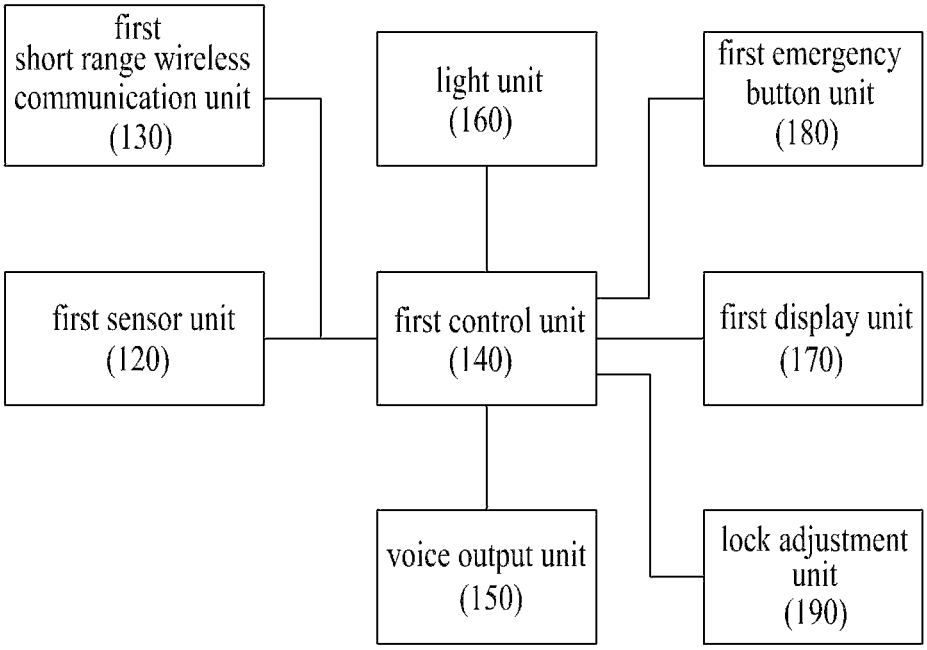
FIG. 3 is a block diagram illustrating a multifunctional portable fire extinguisher case according to the present invention.

FIG. 1 is a perspective view illustrating a multifunctional portable fire extinguisher case according to the present invention, FIG. 2 is an exploded perspective view illustrating a multifunctional portable fire extinguisher case according to the present invention, and FIG. 3 is a block diagram illustrating a multifunctional portable fire extinguisher case according to the present invention.

As shown in FIG. 1 through FIG. 3, the multifunctional portable fire extinguisher case divides broadly into a housing 110*a* and a protective cover 110*b*. the housing 110*a* of a polygonal shape includes an opening portion 111 formed at one side end thereof and a holder 112 for holding a multifunctional portable fire extinguisher 200 formed in the opening portion 111. The protective cover 110*b* is coupled to one side end of the housing 110*a*, that the multifunctional portable fire extinguisher 200 is held therein, so as to protect the multifunctional portable fire extinguisher 200 from the outside.

In the inside portion of the housing 110*a*, a first sensor unit 120, a first short range wireless communication unit 130, a first control unit 140, and a voice output unit 150 are formed. The protective cover 110*b* includes a light unit 160, a first display unit 170, a first emergency button unit 180, and a lock adjustment unit 190.

Here, the first sensor unit 120 serves to detect the temperature, gas, smoke, and power failure and generate a first detection data. At this time, the first sensor unit 120 decides that it is a dangerous to exceed the set point of the temperature, gas, smoke, and power failure and then, generate a first danger data.

Here, the first short range wireless communication unit 130 performs a short range wireless communication with the multifunctional portable fire extinguisher.

Here, the voice output unit 150 outputs a warning call and a request voice signal on a danger level in terms of the temperature, gas, smoke, and power failure detected by the first sensor unit 120 to the outside.

Here, the first control unit 140 serves to control the first sensor unit 120, the first short range wireless communication unit 130, the first display unit 170, and the voice output unit 150.

More concretely, the first control unit 140 serves to transfer the first detection data detected by the first sensor unit 120 to the multifunctional portable fire extinguisher 200 through the first short range wireless communication unit 130.

Also, the first control unit 140 serves to output the first danger data judged by the first detection data detected by the first sensor unit 120 to the first display unit 170 of the protective cover 110*b* by danger level stages based on criteria stored in advance.

Moreover, the first control unit 140 serves to control the voice output unit 150 in such a manner that the warning call on the danger level in terms of the first detection data detected by the first sensor unit 120 and the request voice signal stored in advance are outputted to the outside through the voice output unit 150.

For example, the voice output unit 150 repeatedly outputs at least any of the warning call and the request voice signal stored in advance such as "wailing ~~~my home is 00 street. This is an emergency. Help me." for a period of time.

Here, the light unit 160 includes a plurality of LEDs formed along the protective cover so as to identify the position of the multifunctional portable fire extinguisher case at night. In this case, it is preferred that the intensity of illumination thereof is more than 6 Lux. Also, the color of the LEDs is variable.

Here, the first display unit 170 serves to display the danger level in terms of the temperature, gas, smoke, and power failure detected by the first sensor unit 120. For example, the operation of the first display unit 170 is as follows.

According to the condition of the danger level, the colors are a blue, a yellow, and red in cased of pleasant, warning, and danger conditions respectively. However, the present invention is not limited to the fixed colors and the colors thereof can be varied.

The first emergency button unit 180 adjacent to the first display unit 170 serves to output the dangerous condition through the voice output unit 150 according to the circumstances of the first display unit 170.

Here, the lock adjustment unit 190 serves to separate and open/shuts the protective cover 110*b* from the housing 110*a*.

The multifunctional portable fire extinguisher 200 is fixed to a specific position thereof and installed in the inside thereof and then, the lock adjustment unit 190 serves to lock the corresponding multifunctional portable fire extinguisher case 100 or open and close it according to the danger level.

At this time, the lock adjustment unit 190 can open and close the multifunctional portable fire extinguisher case regardless of the danger level. That is, it is not limited to the opening and closing according to the danger level.

Accordingly, when the heat, the gas, the smoke, and the power failure are generated owing to a fire etc., regardless of the existence of the multifunctional portable fire extinguisher 200 located in the multifunctional portable fire extinguisher case 100, the light is emitted through the light unit 160 and the first display unit 170 of displaying the present conditions, so that it can quickly cope with the fire, thereby preserving life.

Figure 4:
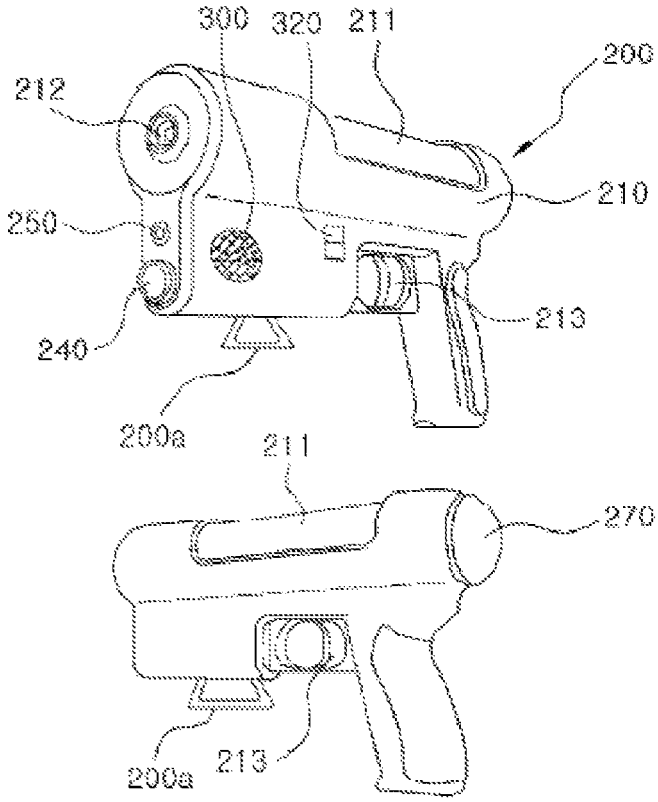
FIG. 4 is a perspective view illustrating a multifunctional portable fire extinguisher according to the present invention.
Figure 5:
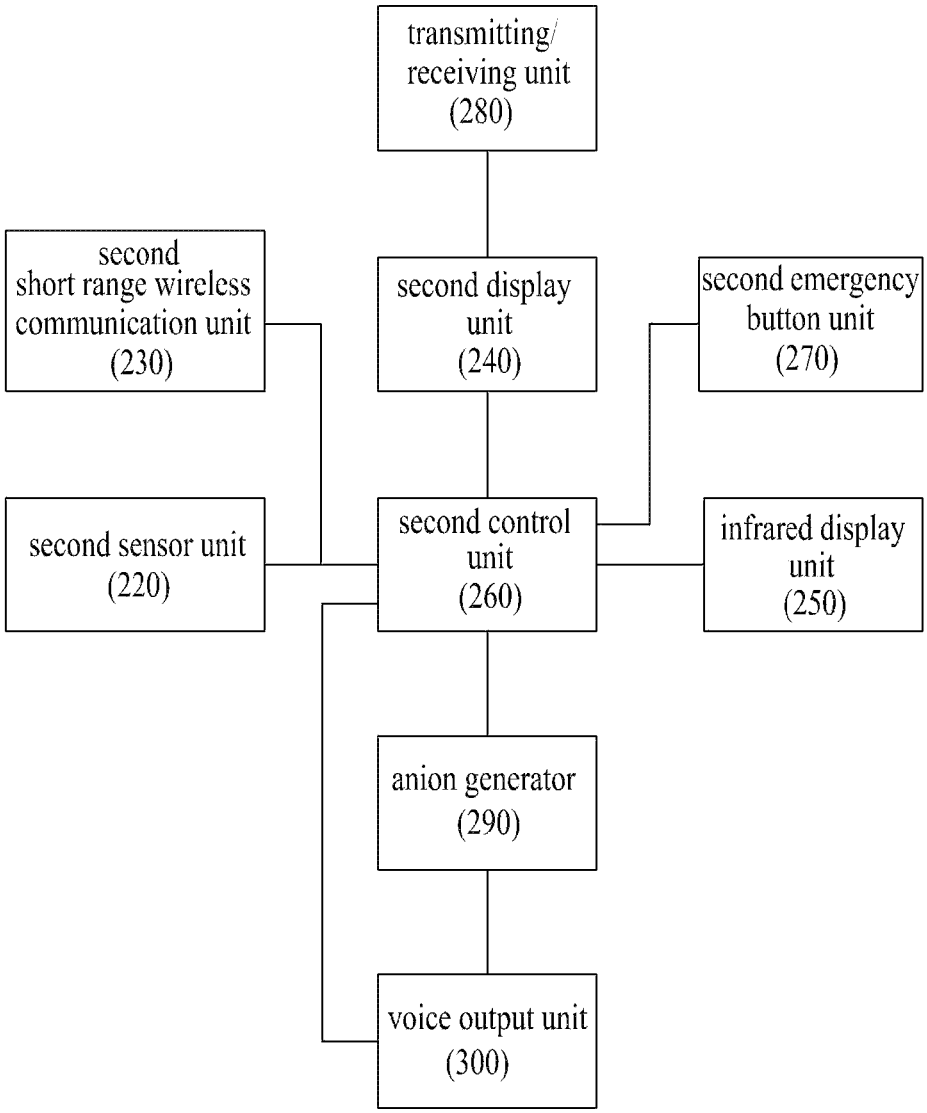
FIG. 5 is a block diagram illustrating a multifunctional portable fire extinguisher according to the present invention.

FIG. 4 is a perspective view illustrating a multifunctional portable fire extinguisher according to the present invention and FIG. 5 is a block diagram illustrating a multifunctional portable fire extinguisher according to the present invention.

As shown in FIG. 4 and FIG. 5, the appearance of the multifunctional portable fire extinguisher 200 has an exterior body 210 with a handgun configuration that sprays a fire-extinguishing liquid of a fire-extinguishing liquid container 211 installed therein through a spraying portion 212 to the outside in accordance with the actuation of a trigger 213. At this time, a foldable tripod 200*a* is formed at a lower end portion of the exterior body 210 so as to stably support the multifunctional portable fire extinguisher 200.

As the fire-extinguishing liquid of a fire-extinguishing liquid container 211, a NaF3, which is a clean fire-extinguishing liquid, can be used. As occasion demands, various fire-extinguishing liquids are filled into the fire-extinguishing liquid container 211 and then, they are sprayed out, so that it can be used for extinguishing the early fire.

Also, instead of the fire-extinguishing liquid, a pepper gas is filled into the fire-extinguishing liquid container 211, so that it can be used for self-defense.

An infrared display unit 250 and a second display unit 240 are sequentially formed from the lower portion of the spraying portion 212. However, the order thereof is variable. Also, a second emergency button unit 270 is formed at a rear surface of the exterior body 210.

The second display unit 240 includes a cylindrical case protruded from and fixed to a front surface of the exterior body 210 and LEDs formed at the center of the cylindrical case.

The second display unit 240 includes the plurality of LEDs formed therein so as to identify the position of the multifunctional portable fire extinguisher at night. Also, it is preferred that the intensity of illumination of the LEDs inserted into and fixed to a substrate is more than 6 Lux.

In the meantime, the second display unit 240 can be arranged and configured so as to express various figures and charters etc., or various colors are configured so as to display various colors.

The infrared display unit 250 located at the upper portion of the second display unit 240 serves to inform outsiders of the dangerous conditions together with the second display unit 240. Also, it is displayed with an infrared light.

The second emergency button unit 270 serves to generate an emergency data so as to inform the dangerous situations to the outside.

Hereinafter, the second display unit 240, the infrared display unit 250, and the second emergency button unit 270 will be again described.

The internal elements of the multifunctional portable fire extinguisher according to the present invention includes a second sensor unit 220, a second short range wireless communication unit 230, the second display unit 240, the second emergency button unit 270, an anion generator 290, a voice output unit 300, the infrared display unit 250, a transmitting/receiving unit 280, and a second control unit 260.

Here, the second short range wireless communication unit 230 serves to receive the first detection data detected by the first sensor unit 120 of the multifunctional portable fire extinguisher case 100 through the first short range wireless communication unit 130 and transfer it to the second control unit 260.

Here, the second sensor unit 220 serves to detect the temperature, gas, smoke, and power failure on the outside of the multifunctional portable fire extinguisher 200, generate a second detection data according to the detected signal, and transmit it to the second control unit 260. At this time, the second detection data decides that it is a dangerous to exceed the set point of the temperature, gas, smoke, and power failure and then, generate a second danger data.

Here, the second display unit 240 serves to express various colors and perform various displays so as to identify the position of the multifunctional portable fire extinguisher 200 at night according to the control of the second control unit 260. Also, the second display unit 240 serves to display the danger level in terms of the temperature, gas, smoke, and power failure owing to the second danger data with the light of various colors.

Here, in the second emergency button unit 270, an input signal is input during occurrence of robbers, thieves, and patients. The emergency data is transferred to the second control unit 260 according to the input signal. Also, according to the input of the second emergency button unit 270, the AC power is converted into the DC power in the multifunctional portable fire extinguisher 200.

Here, in the anion generator 290, the temperature, gas, smoke, and power failure on the outside of the multifunctional portable fire extinguisher 200 are detected by the second sensor unit 220 according to the control of the second control unit 260 and then, if judged necessary, it is operated according to the second detection data.

Here, the voice output unit 300 outputs a warning call and a request voice signal on a danger level in terms of the temperature, gas, smoke, and power failure detected by the second sensor unit 220 to the outside.

Here, the second control unit 260 serves to control the second sensor unit 220, the second short range wireless communication unit 230, the second display unit 240, and the voice output unit 300. Also, the second control unit 260 serves to output the second danger data judged by the second detection data detected by the second sensor unit 220 to the second display unit 240 by danger level stages based on criteria stored in advance. Moreover, the second control unit 260 serves to control the voice output unit 300 in such a manner that the warning call on the danger level in terms of the first detection data detected by the second sensor unit 220 and the request voice signal stored in advance are outputted to the outside through the voice output unit 300.

For example, the voice output unit 300 repeatedly outputs at least any of the warning call and the request voice signal stored in advance such as "wailing ~~~my home is 00 street. This is an emergency. Help me." for a period of time.

The infrared display unit 250 serves to receive the first detection data through the second short range wireless communication unit 230 according to the second control unit 260 or receive the second detection data through the second sense unit 220 so as to inform outsiders of the dangerous conditions through the infrared light in a case that the data is not within the range of a set point thereof.

Also, the infrared display unit 250 can be used to inform the emergency situations to the outside through the infrared light according to the data received from the second control unit 260.

Here, the transmitting/receiving unit 280 serves to transmit the emergency data, that is, address information stored in advance and transmitted to the second control unit 260 to the servers of public institutions or mobile terminals set in advance.

Here, the second control unit 260 serves to control the second display unit 240 and the infrared display unit 250 in such a manner that they output the data received from the second short range wireless communication unit 230, the second sensor unit 220, and the second emergency button unit 270 thereon.

At this time, the second control unit 260 serves to control the second short range wireless communication unit 230 so as to receive the first detection data from the first short range wireless communication unit 130. The second control unit 260 allows the dangerous level to be outputted through the second display unit 240 and the infrared display unit 250. That is, in a case that the multifunctional portable fire extinguisher 200 is separated from the multifunctional portable fire extinguisher case 100, it can grasp the dangerous information in the region provided with the multifunctional portable fire extinguisher case, thereby quickly coping with it.

Also, the second control unit 260 allows the dangerous level of the second dangerous data by means of the second detection data detected by the second sensor unit 230 to be outputted through the second display unit 240, the infrared display unit 250, and the voice output unit 300.

Moreover, the second control unit 260 serves to receive the second detection data of detecting the temperature, gas, smoke, and power failure on the outside of the multifunctional portable fire extinguisher 200 through the second sensor unit 220. At this time, in a case that the second control unit 260 judges the generation of the anion is needed, it issues an order to the anion generator 290, thereby generating the anion through the anion generator 290.

The multifunctional portable fire extinguisher 200 and the multifunctional portable fire extinguisher case 100 according to the present invention can be interconnected to each other. However, they can be also, independently used.

Figure 6:
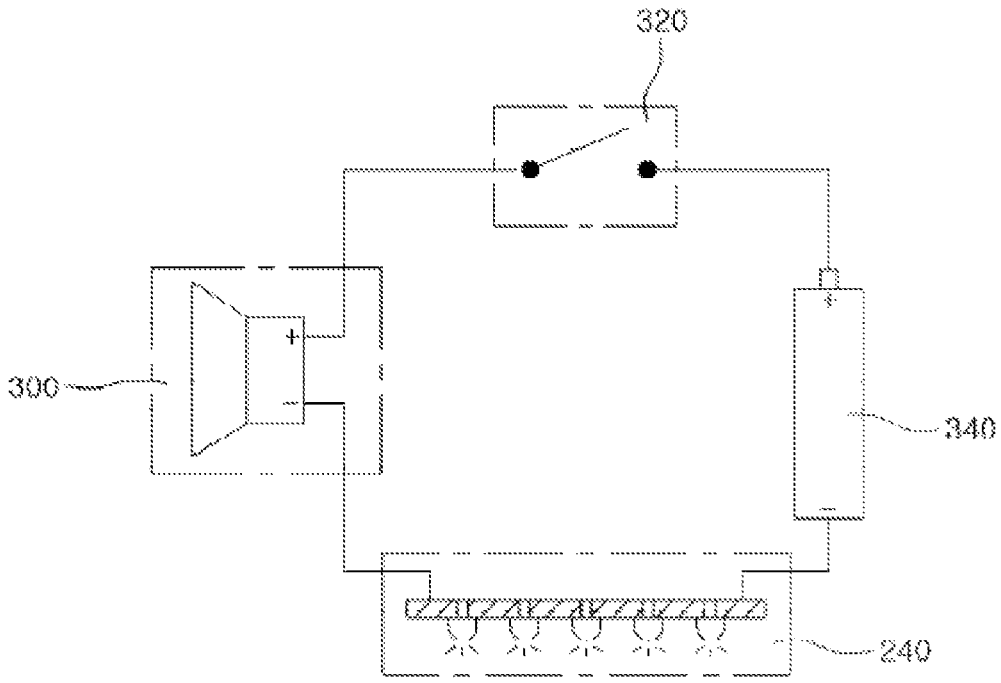
FIG. 6 is a circuit diagram illustrating a switch portion for manually operating a multifunctional portable fire extinguisher according to the present invention.

FIG. 6 is a circuit diagram illustrating a switch portion for manually operating a multifunctional portable fire extinguisher according to the present invention.

As shown, a manual switch 320 for manually operating the second display unit 240 and the voice output unit 300 is formed at the exterior body 210 of the multifunctional portable fire extinguisher 200.

The manual switch 320 is operated by the power of a battery, which is separately formed inside the exterior body 210, so that the light beam of various colors can be irradiated through the LEDs of the second display unit 240 and the dangerousness can be informed through the speaker of the voice output unit 300.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A multifunctional portable fire extinguisher system comprising:

a multifunctional portable fire extinguisher with a handgun configuration that sprays a fire-extinguishing liquid stored therein through a spraying portion to the outside in accordance with the actuation of a trigger; and a multifunctional portable fire extinguisher case comprising a housing for housing the multifunctional portable fire extinguisher having a first sensor unit for detecting a temperature, a gas, a smoke, and a power failure and for generating a first detection data, and a first short range wireless communication unit for performing a short range wireless communication with the multifunctional portable fire extinguisher; and a protective cover for protecting the multifunctional portable fire extinguisher housed in the housing having a first display unit for displaying a danger level in terms of the temperature, the gas, the smoke, and the power failure detected by the first sensor unit, and a lock adjustment unit for separating and opening/closing the protective cover from the housing.

2. The multifunctional portable fire extinguisher system as recited in claim 1, wherein the multifunctional portable fire extinguisher case further comprises a voice output unit for outputting a warning call and a request voice signal on the danger level in terms of the temperature, the gas, the smoke, and the power failure detected by the first sensor unit to the outside.

3. The multifunctional portable fire extinguisher system as recited in claim 1, wherein the multifunctional portable fire extinguisher case further comprises a first control unit for controlling the first sensor unit, the first short range wireless communication unit, and the first display unit and a light unit for identifying a position of the multifunctional portable fire extinguisher case.

4. The multifunctional portable fire extinguisher system as recited in claim 1, wherein the multifunctional portable fire extinguisher case further comprises a first emergency button unit for issuing orders for delivering a warning call and a warning voice to a voice output unit.

5. The multifunctional portable fire extinguisher system as recited in claim 1, wherein the multifunctional portable fire extinguisher further comprises a second short range wireless communication unit for performing a short range wireless communication with the first short range wireless communication unit of the multifunctional portable fire extinguisher case; a second sensor unit for detecting the temperature, the gas, the smoke, and the power failure and generating a second detection data according to the detected signal formed inside the multifunctional portable fire extinguisher; a second display unit for displaying the danger level in terms of the temperature, the gas, the smoke, and the power failure; a second emergency button unit for generating an emergency data so as to inform dangerous situations to the outside; and infrared display unit for displaying the danger level in terms of the temperature, the gas, the smoke, and the power failure through an infrared light; and a second control unit for controlling the second display unit and the infrared display unit in such a manner that they output data received from any of the second short range wireless communication unit, the second sense unit, and the second emergency button unit thereon.

6. The multifunctional portable fire extinguisher system as recited in claim 5, wherein the multifunctional portable fire extinguisher further comprises a transmitting/receiving unit for transmitting address information stored in advance to a server of public institutions or mobile terminals set in advance.

7. The multifunctional portable fire extinguisher system as recited in claim 5, wherein the multifunctional portable fire extinguisher further comprises an anion generator for generating an anion in accordance with the detected temperature, gas, smoke, and power failure.

8. The multifunctional portable fire extinguisher system as recited in claim 5, wherein an AC power is converted into a DC power in the multifunctional portable fire extinguisher according to an input of the second emergency button unit.

9. The multifunctional portable fire extinguisher system as recited in claim 5, wherein the multifunctional portable fire extinguisher further comprises a voice output unit for outputting a warning call and a request voice signal on the danger level in terms of the temperature, the gas, the smoke, and the power failure detected by the second sensor unit to the outside.

10. The multifunctional portable fire extinguisher system as recited in claim 5, wherein a manual switch for manually operating the second display unit and a voice output unit is formed at an exterior body of the multifunctional portable fire extinguisher and the manual switch is operated by the power of a battery, which is formed inside the exterior body, so that a light beam is irradiated through the second display unit and a dangerousness is informed through a speaker of the voice output unit.

* * * * *